US012405088B2

(12) United States Patent
Jones et al.

(10) Patent No.: US 12,405,088 B2
(45) Date of Patent: Sep. 2, 2025

(54) DUAL-MODE ROLL/NOD GIMBALLED SEEKER FOR A FORMING WARHEAD

(71) Applicant: Raytheon Company, Arlington, VA (US)

(72) Inventors: Jaylan S. Jones, Tucson, AZ (US); Frederick B. Koehler, Tucson, AZ (US); Paul S. MacDonald, Tiverton, RI (US); Ronald L. Roncone, Tucson, AZ (US); John Regis Leach, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 12 days.

(21) Appl. No.: 18/530,942

(22) Filed: Dec. 6, 2023

(65) Prior Publication Data

US 2025/0189272 A1 Jun. 12, 2025

(51) Int. Cl.
*F41G 7/22* (2006.01)
*F42B 12/10* (2006.01)

(52) U.S. Cl.
CPC ..... *F41G 7/2213* (2013.01); *F42B 12/10* (2013.01)

(58) Field of Classification Search
CPC . F41G 7/20; F41G 7/22; F41G 7/2213; F41G 7/222; F42B 12/10
USPC ..... 244/3.16, 3.17; 102/476
See application file for complete search history.

(56) References Cited

U.S. PATENT DOCUMENTS

| | | | | |
|---|---|---|---|---|
| 5,363,766 | A | 11/1994 | Brandon et al. | |
| 6,343,767 | B1 * | 2/2002 | Sparrold | F41G 7/2253 244/3.15 |
| 7,905,182 | B2 | 3/2011 | Janik et al. | |
| 8,259,291 | B2 * | 9/2012 | Taylor | F41G 7/008 356/3.01 |
| 8,829,404 | B1 * | 9/2014 | Rinker | F41G 7/008 250/214 R |
| 2011/0073704 | A1 * | 3/2011 | Jenkins | F41G 7/008 244/3.16 |
| 2012/0085895 | A1 * | 4/2012 | Martin | F41G 7/2293 250/229 |
| 2017/0082721 | A1 * | 3/2017 | Trail | F41G 7/2253 |

* cited by examiner

*Primary Examiner* — John Cooper
(74) *Attorney, Agent, or Firm* — Schwegman Lundberg & Woessner, P.A.

(57) ABSTRACT

A dual-mode roll/nod gimballed seeker is configured to provide an unobstructed path for a forming-warhead penetrator. A nod assembly includes first and second seekers separately offset from the roll axis whose FOV overlap within a stand-off range to a target. A roll gimbal rotates the dome and nod assembly around the roll axis. A nod gimbal rotates the nod assembly about a nod axis over a nod FOR that causes the seekers to cross the roll axis and obstruct a path along the roll axis. At terminal, the nod gimbal rotates the nod assembly to a nominal nod angle at which the path is unobstructed to detonate the forming warhead and project a penetrator along the path through the dome. This alleviates the need for a precursor charge and saves precious volume in the airframe, which is of particular import for small diameter warheads, in particular those having a diameter of no more than 8 inches.

20 Claims, 11 Drawing Sheets

DUAL-MODE ROLL/NOD GIMBALLED SEEKER FOR A FORMING WARHEAD

GOVERNMENT LICENSE RIGHTS

This disclosure was made with government support under W9124-P-19-9-0001. The government has certain rights in this invention.

BACKGROUND

Field

This disclosure relates to dual-mode roll/nod gimballed seekers for warheads, and more particularly to a configuration of the dual-mode roll/nod gimballed seeker to provide an unobstructed path for a forming-warhead penetrator.

Description of the Related Art

Warheads in rockets, gun-fired projectiles, missiles, unmanned aerial vehicles (UAV) or the like may be fitted with a dual-mode roll/nod gimballed seekers to detect, classify, identify and provide terminal guidance to a target. The seeker is positioned within a dome that is fixed to the front of the warhead. The dome is transparent in the different modes e.g., IR, visible or RF bands. To best utilize the available volume within the dome, the multiple modes are integrated into a single co-boresighted seeker that is mounted on a roll/nod gimbal within the dome.

Forming warheads e.g., a shaped-charge or an explosively formed penetrator (EFP) are configured with an explosive charge and metal liner such that upon detonation of the charge, the metal liner forms a penetrator that is accelerated to very high speeds traveling along the axis. A shaped-charge forms both a slug and a metal jet. The metal jet is only about 25% of the mass but is accelerated to very high speeds. The 75% of the mass that forms the slug travels at much slower speeds and is largely ineffective. An EFP forms approximately 100% of the liner mass into a slug. This slug travels slower than the metal jet but uses 100% of the mass. Whether the forming warhead is a shaped-charge or an EFP is largely dictated by the shape e.g., apex angle of the explosive charge and metal liner.

For forming warheads, upon detonation the penetrator is formed and must pass through the on-axis gimbal structures and seeker. For large diameter warheads (>10"), the energy in the penetrator is such that the gimbal/seeker are not a significant impediment. For smaller diameter warheads (e.g., <8"), the gimbal/seeker is an impediment. In these configurations, a precursor charge (e.g., an EFP) is positioned in front of the forming warhead and detonated to project a slug along the axis form a hole through the seeker just prior to detonation of the forming warhead to remove the impediment. In smaller diameter UA Vs/projectiles/rockets/missiles, the precursor charge occupies scarce volume in the forward portion of the airframe.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a dual-mode roll/nod gimballed seeker configured to provide an unobstructed path for a forming-warhead penetrator. More particularly, at terminal the seeker is rotated to a nominal nod angle at which a path along the roll axis through the seeker is unobstructed. The penetrator does not have to travel through either the seeker or roll/nod gimbal structures. This alleviates the need for a precursor charge and saves precious volume in the airframe, which is of particular import for small diameter warheads, in particular those have a diameter of no more than 8 inches.

In an embodiment, a forming warhead is positioned within an airframe and configured to project a penetrator forward along a roll axis. A dome is mounted on a roll gimbal positioned forward of the forming warhead. A nod assembly includes first and second seekers separately offset from the roll axis whose field-of-view (FOV) overlap within a stand-off range to a target that roll with the dome. A nod gimbal rotates the nod assembly about a nod axis over a nod field-of-regard (FOR) that causes the seekers to cross the roll axis and obstruct a path along the roll axis. At terminal, the nod gimbal rotates the nod assembly to a nominal nod angle at which the path is unobstructed to detonate the forming warhead and project a penetrator along the path through the dome.

In an embodiment, the diameter of the airframe and the diameter of the dome are no greater than 8 inches. The provision of an unobstructed path for the penetrator (without the need for a precursor charge) being of particular importance in systems in which the forming warhead, hence explosive energy is limited. Furthermore, in volume constrained domes the modes must be separated to provide sufficient volume for each seeker. A single multi-mode seeker offset from the roll axis would be too small. As the seeker nods, it is preferably configured to stay within an outer mold line (OML) of the aircraft.

In an embodiment, the first and second seekers are positioned such that at the nominal nod angle are offset from the roll axis, preferably on opposite sides of the roll axis to provide the unobstructed path between the seekers. In certain embodiments, nod motors are positioned at opposite ends of the nod axis within the dome. The first and second seekers are spaced apart from and on opposing sides of a roll/nod plane at the nominal nod axis to best utilize the constrained volume within the dome.

In an embodiment in which the first and second seekers are offset from the roll axis, hence off-axis from the dome, if either seeker is EO, either the surface of the dome opposite that EO seeker must be formed as a flat window so that light passing through remains parallel or an arch-corrector must be positioned between the EO seeker and the dome to restore the parallelism of the light.

In an embodiment, the dome is formed with an aft opening that defines a volume for formation of the penetrator upon detonation of the forming warhead. A membrane is suitably attached across the aft opening to prevent contamination of the seekers within the dome.

In an embodiment, the roll gimbal includes a ring-shaped roll bearing and a roll motor positioned between the airframe and dome to roll the dome about the roll axis without obstructing the path along the roll axis. A slip ring is suitably positioned to pass electrical signals back-and-forth across the roll gimbal.

In an embodiment, the dome incudes a middle section positioned between first and second outer sections. The middle section is part of the nod assembly and the outer sections project forward from the roll gimbal to roll the nod assembly. A nod motor is positioned on the nod axis in one of the outer sections to rotate the nod assembly about the nod axis. The first and second seekers are spaced apart from and on opposite sides of a roll/nod plane at the nominal nod angle. Since both seekers are fixed relative to the middle section of the dome, the dome may be formed with first and second windows opposite the respective seekers that are tailored to their EO or RF mode of operation. This is less expensive and better performing than a single larger window that must be transparent in both the EO and RF spectra.

In an embodiment, a one-piece dome is mounted on the roll gimbal. A nod motor is positioned on the nod axis to rotate the nod assembly about the nod axis. The first and second seekers are spaced apart from and on opposite sides of a roll/nod plane at the nominal nod angle. Because both seekers nod relative to the dome, the dome is formed with a single window that is transparent to both modes of operation.

These and other features and advantages of the disclosure will be apparent to those skilled in the art from the following detailed description of preferred embodiments, taken together with the accompanying drawings, in which:

DETAILED DESCRIPTION

The present disclosure provides a dual-mode roll/nod gimballed seeker configured to provide an unobstructed path for a forming-warhead penetrator. More particularly, at terminal the seeker is rotated to a nominal nod angle at which a path along the roll axis through the seeker is unobstructed. The penetrator does not have to travel through either the seeker or roll/nod gimbal structures. This alleviates the need for a precursor charge and saves precious volume in the airframe, which is of particular import for small diameter warheads, in particular those having a diameter of no more than 8 inches.

For most of the applications e.g., UAV, missiles, rockets or gun-fired projectiles, the seeker has a generically spherically shaped dome for optimum aerodynamic performance. However, the seeker dome may have other shapes including spherical with a flat window for EO seekers, conical or ogive.

Figure 1:
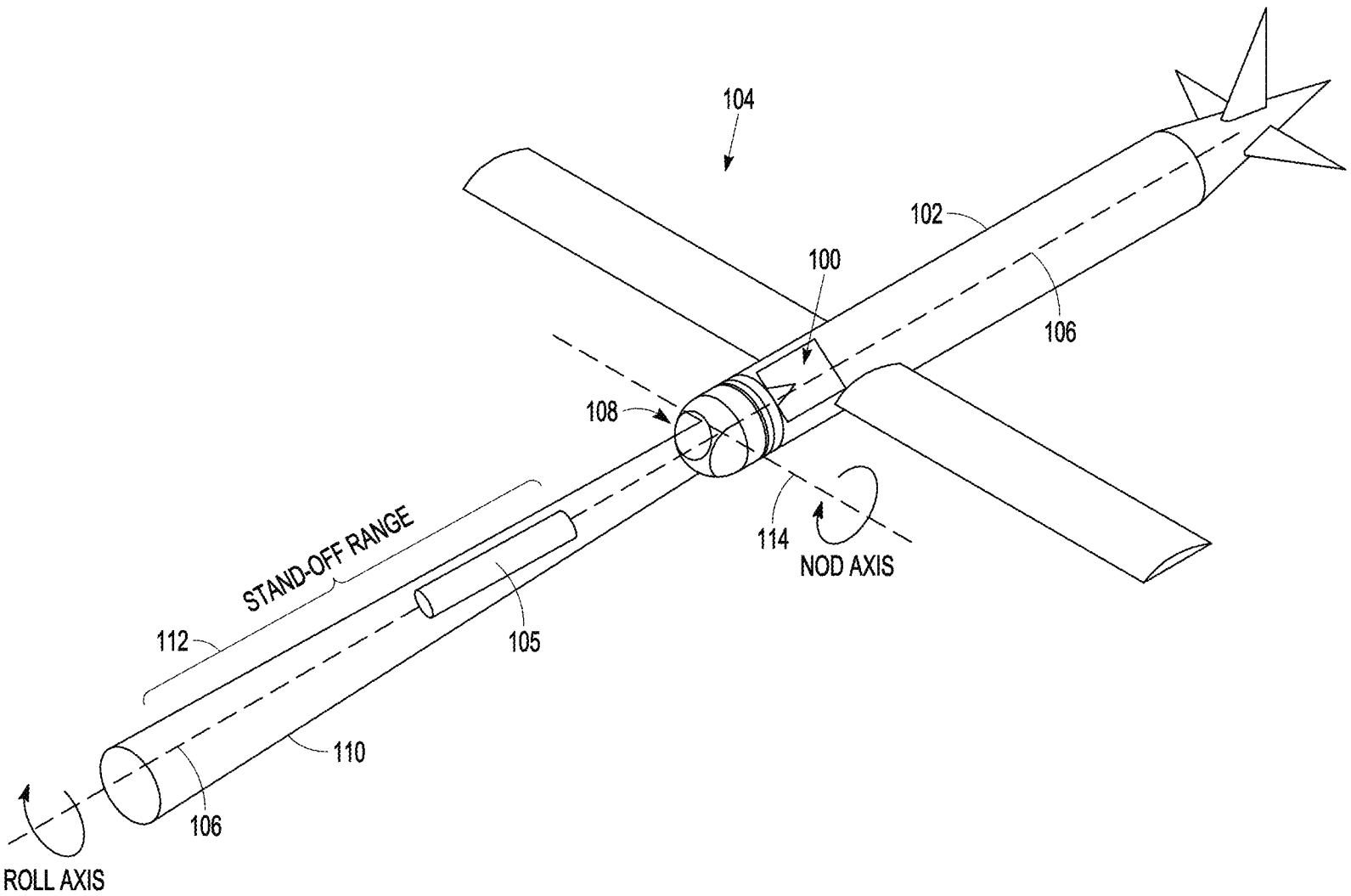
FIG. 1 is a depiction of UAV provided with a forming warhead and dual-mode roll/nod gimballed seeker in which the FOV overlap in a stand-off range to target.

Referring now to FIG. 1, in an embodiment a forming warhead 100 is positioned forward with an airframe 102 of a UAV 104 and configured to project a penetrator 105 forward along a roll axis 106 (aka the longitudinal axis) of the airframe upon detonation. Forming warhead 100 may be a shaped-charge or an explosively formed penetrator (EFP). A dual-mode roll/nod gimballed seeker 108 is mounted on the airframe 102 forward of forming warhead 100. The seeker includes first and second seekers positioned with the dome with a fixed relationship to each other. The seekers may, for example, operate in the electro-optical (EO) such as Visible, IR (infrared), UV (ultra-violet) or SAL (semi-active laser) or RF (radio frequency) bands. The seekers are separately positioned and individually offset from the roll axis 106 (at a nominal nod angle) such that their FOV provide an overlapping FOV 110 within a stand-off range to target 112. In the initial detection period at much greater distances to target RF can see a lot further than EO. During the critical period for making terminal firing decisions, it is critical that the UAV can image a target with both seekers. The roll gimbal can rotate to cover a 360 degree roll field-of-regard (FOR). The nod gimbal can rotate between +/−90 degrees about a nod axis 114 to cover a nod FOR. Rotation of the seekers over the nod FOR causes the seekers to cross the roll axis 106 and obstruct the path along the roll axis. Just prior to detonation of forming warhead 100, a controller issues a command to the nod gimbal to rotate to the nominal nod angle such that the penetrator 105 moves unimpeded along the roll axis 106 and unobstructed path between seekers through the dome.

Referring now to FIGS. 2A-2C and 3A-3C, an embodiment of a seeker and warhead assembly 200 includes a forming warhead 202 including an explosive 204 and metal liner 206 and a dual-mode roll/nod gimballed seeker 210 that is adapted to couple to a front end of a cylindrical airframe forward of forming warhead 202.

A roll gimbal 212 is configured to provide rotation about a roll axis 214 over a roll FOR (e.g., 360 degrees) without obstructing a path along roll axis 214. Roll gimbal 212 includes a ring-shaped roll bearing 216 and a ring-shaped roll motor 218 sized to the open cylindrical end of the airframe. A part of the motor 218 (e.g., the stator) is fixed to the airframe and another part (e.g., the rotor) is allowed to rotate on roll bearing 216. An encoder (or resolver) 217 provides measurements of the roll angle of the motor, hence the seeker and in this embodiment is integrated with roll motor 218. A ring-shaped slip ring 219 positioned aft of roll motor 218 enables continuous rotation for roll while allowing the transmission of power and electrical signals between processing electronics 220 in the airframe and the gimbal electronics 222 for the seeker. Relative to the airframe, the processing electronics are stationary, whereas the gimbal electronics are not stationary (e.g., nod and roll).

A dome 230 is positioned forward of and coupled to roll gimbal 212 for rotation about roll axis 214. In this embodiment, dome 230 includes a ring 232 that is attached to roll gimbal 212. First and second outer sections 234 and 236, respectively, project forward from ring 232. A middle section 238 is positioned between outer sections 234 and 236. Taken together the outer and middle sections have the desired aerodynamic shape of the dome e.g., spherical.

Middle section 238 has an aft opening 240 that together with the ring-shaped bearing and motor assembly and slip ring both define a volume for formation of the penetrator upon detonation of the forming warhead and allows the penetrator to move forward along the roll axis without impacting the back of the dome. A membrane 241 is suitably attached across aft opening 240 to prevent contamination within the dome. Any impediment to the penetrator from the membrane is negligible. In this embodiment, the airframe and dome have the same diameter, which is no greater than 8 inches.

A nod assembly 250 includes middle section 238 of the dome 230 and first and second seekers 252 and 254 configured to operate in different modes in EO or RF. First and second seekers 252 and 254 have first and second FOV 256 and 258, respectively, projects forward through different regions of the middle section 238 of the dome. The seekers are separately positioned and offset from roll axis 214, and more particularly on opposing sides of a roll/nod plane 259 and centered above and below roll axis 214 such that first and second FOV 256 and 258 overlap within a stand-off range to target. Because the first and second seekers are fixed relative to middle section 238 of the dome, the different regions of the middle section 238 of the dome cane be formed as to distinct windows 260 and 262 optimized for the respective seeker. Alternately, a single large window can be formed to cover both regions. However, the materials required to provide sufficient transparency for both modes tend to be expensive and performance may suffer. This is the case in current seekers in which a multi-mode seeker is mounted on a roll/nod gimbal inside a 1-piece dome.

Figure 2A:
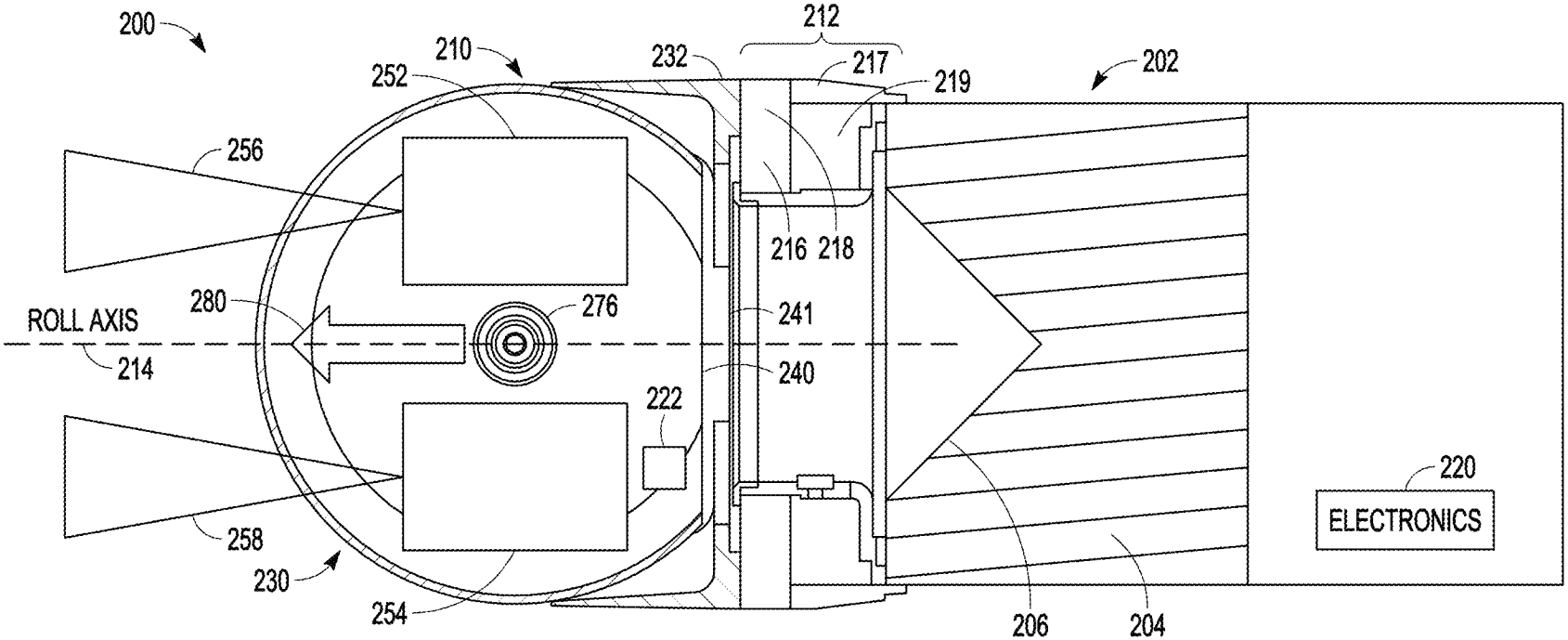
FIGS. 2A-2C are side section and end-on views of an embodiment of a forming warhead and dual-mode roll/nod gimballed seeker in which a path through the seeker is unobstructed at a nominal nod angle and obstructed by the seekers as the nod gimbal moves through the nod FOR, respectively.
Figure 2B:
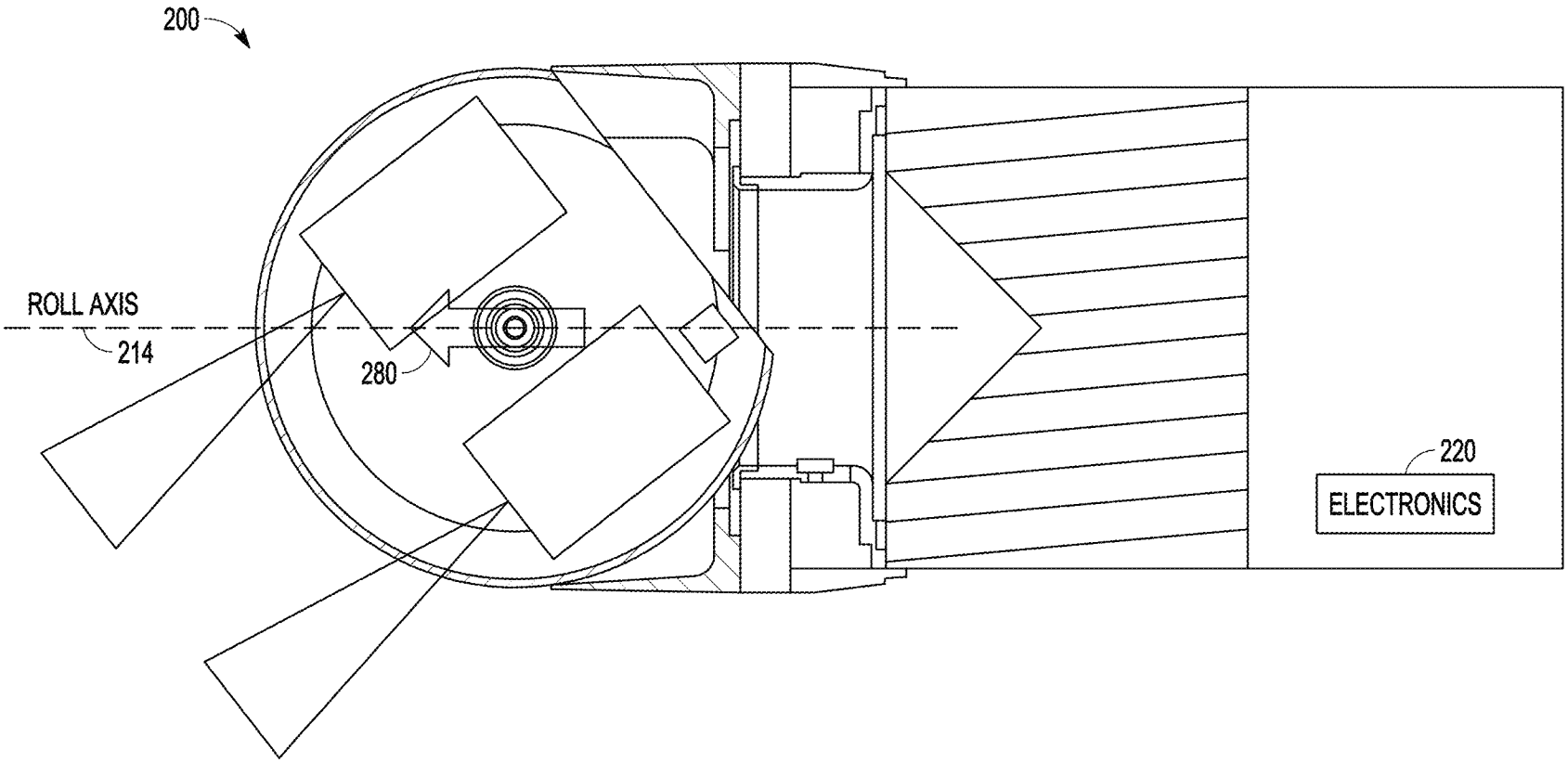
Figure 2C:
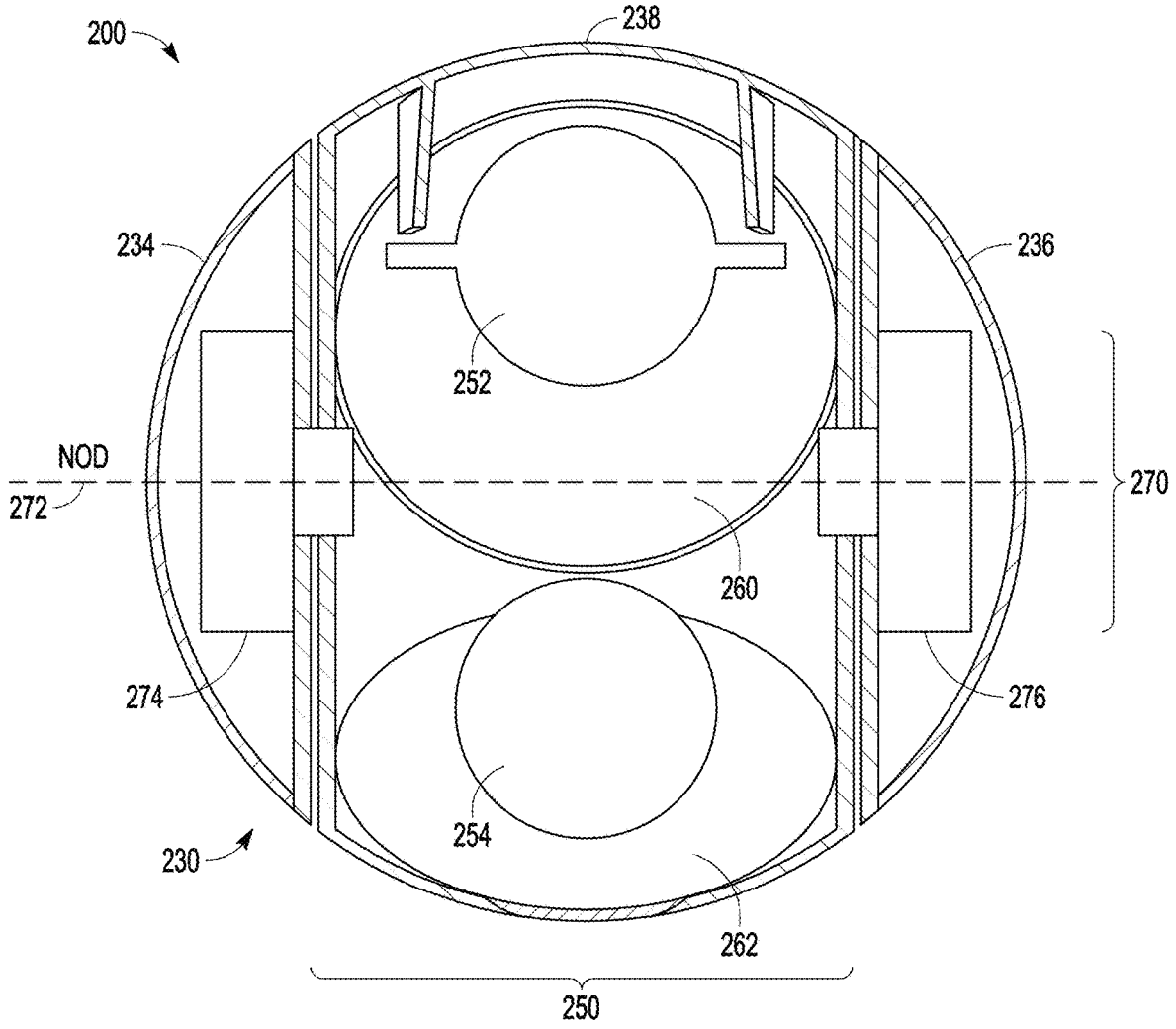
Figure 3A:
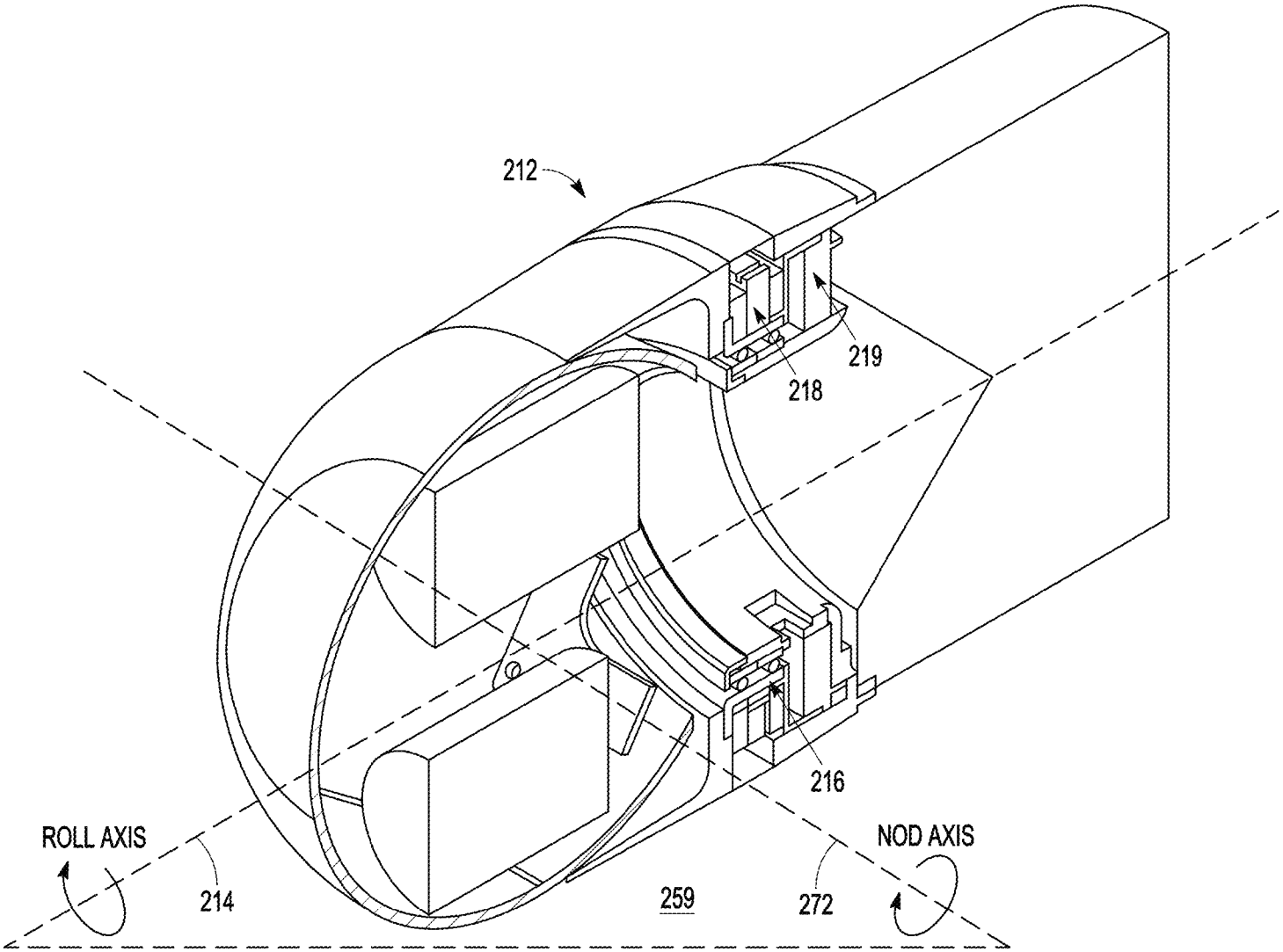
FIGS. 3A-3C are different section views of the seekers to illustrate an embodiment of the roll and nod gimbals of the seeker.
Figure 3B:
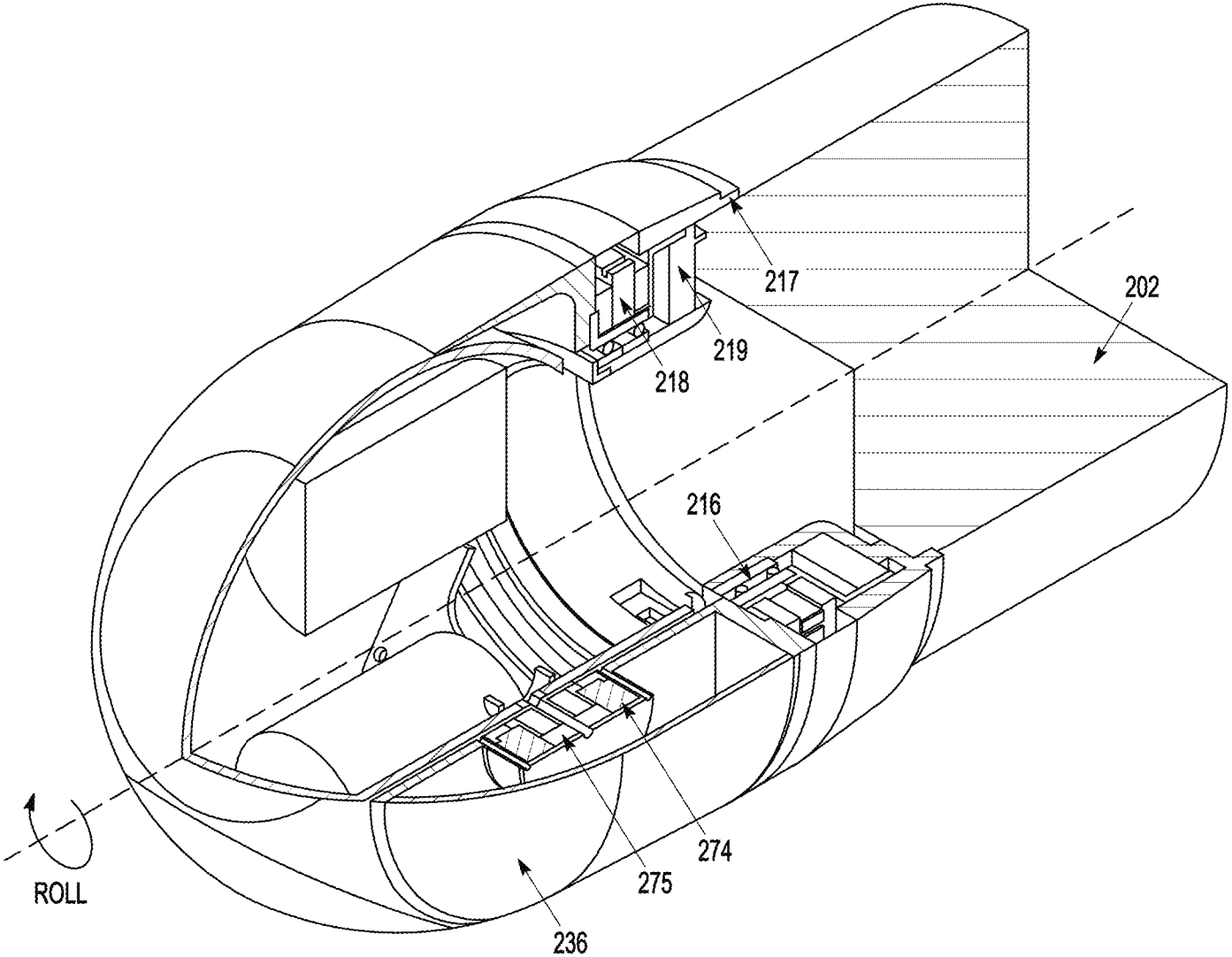
Figure 3C:
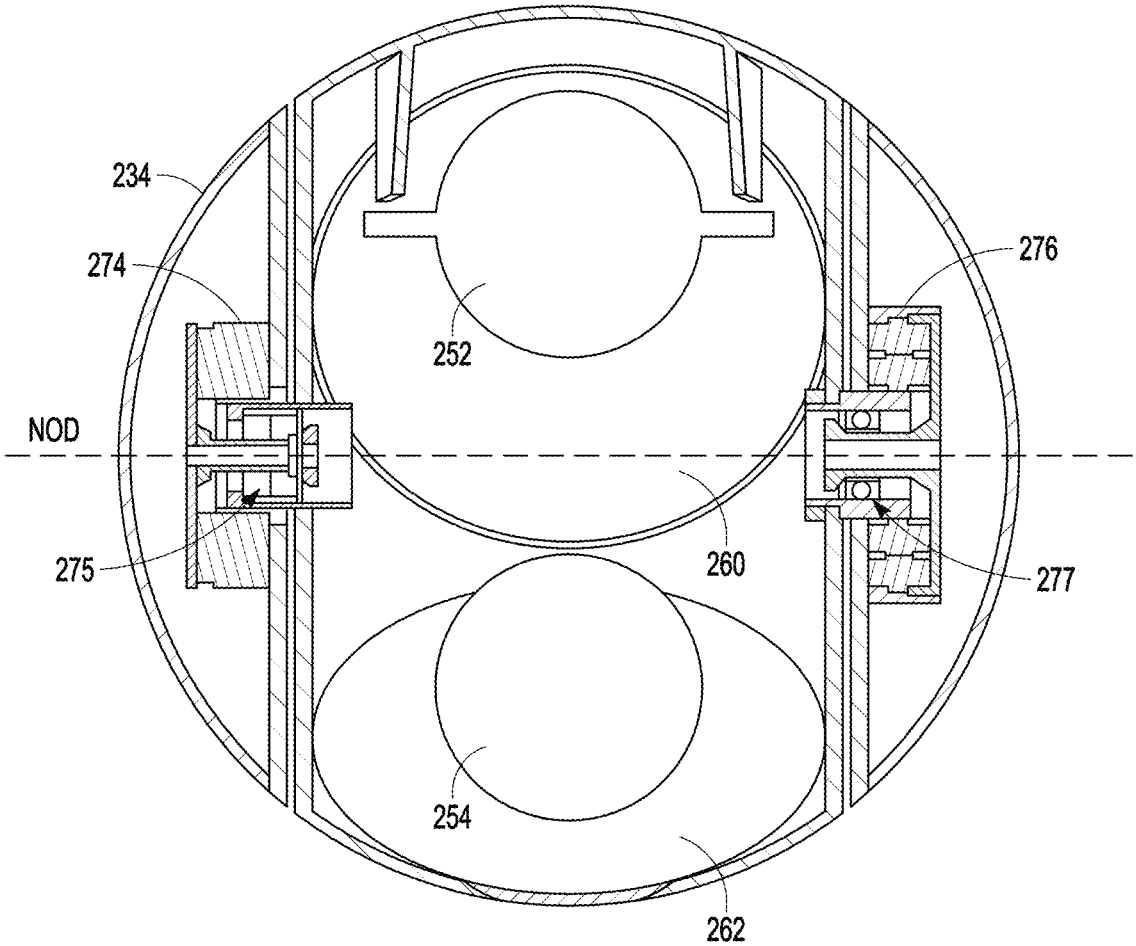

A nod gimbal 270 is configured to rotate the nod assembly 250 about a nod axis 272 perpendicular to roll axis 214. Nod gimbal 270 includes a nod motor 274 and a nod resolver 276, that are positioned on the nod axis 272 with nod bearings 275 and 277, respectively in the first and second outer sections 234 and 236, respectively, and coupled to opposing sides of middle section 238 to rotate the nod assembly through a nod FOR. Nod resolver 276 (or encoder) measures the motor angles, hence the nod angle of the seeker. The nod axis suitably passes through a center of the dome such that rotation of middle section 238 of the dome stays within an outer mold line (OML) of the aircraft (assuming equal diameters for the aircraft and dome). The nod motors are positioned so they do not obstruct the path along the roll axis. At a nominal nod angle (zero degrees in this configuration), first and second seekers 252 and 254 are position on opposing sizes of and spaced apart from roll/nod plane 259 such that a path 280 along roll axis 214 is unobstructed. More particularly, at the nominal nod angle the seekers and roll and gimbal structures do not obstruct path 280 at the nominal nod angle. However, rotation of nod assembly 250 about the nod axis over the nod FOR causes the first and second seekers to cross the roll axis 214 and obstruct path 280 along roll axis 214 as shown in FIG. 2B.

Figure 4A:
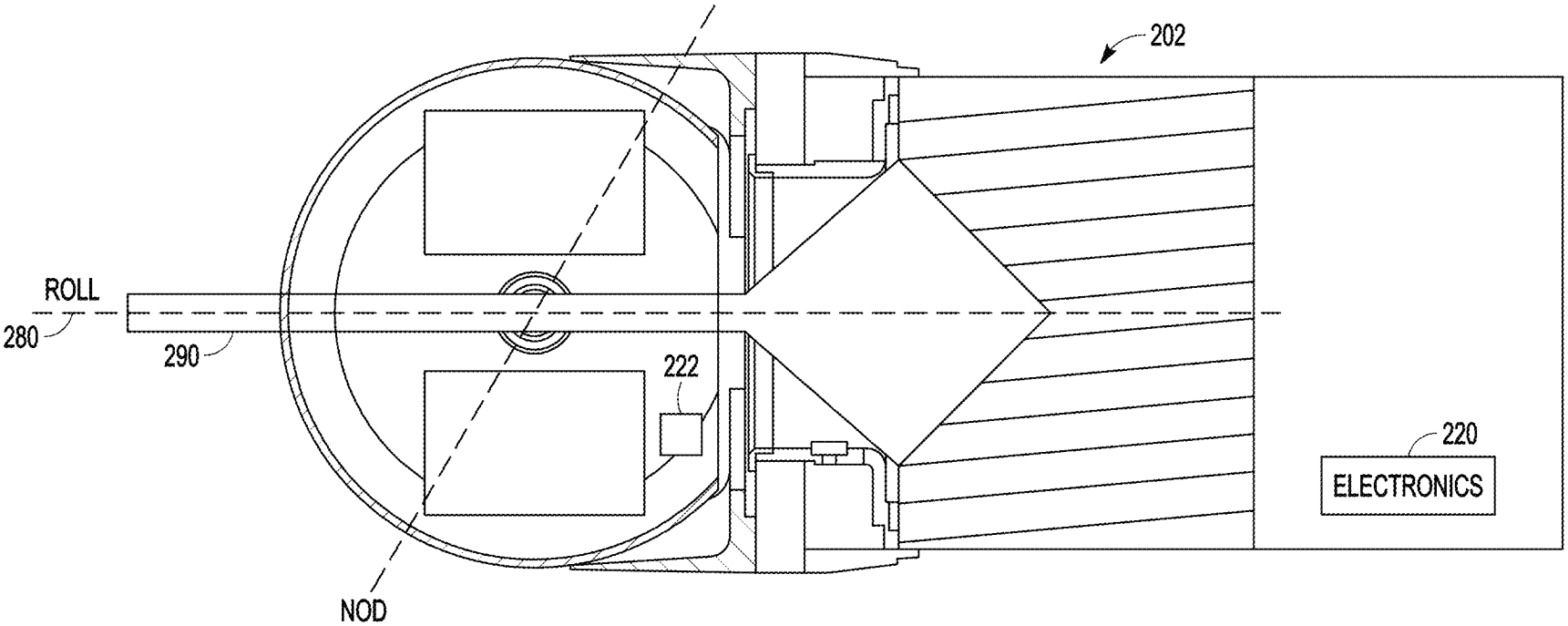
FIGS. 4A-4B are a side section and end on section view of the seeker in which the seeker has been rotated to the nominal nod angle and the forming warhead has been detonated to project a penetrator along the unobstructed path on the roll axis through the dome.
Figure 4B:
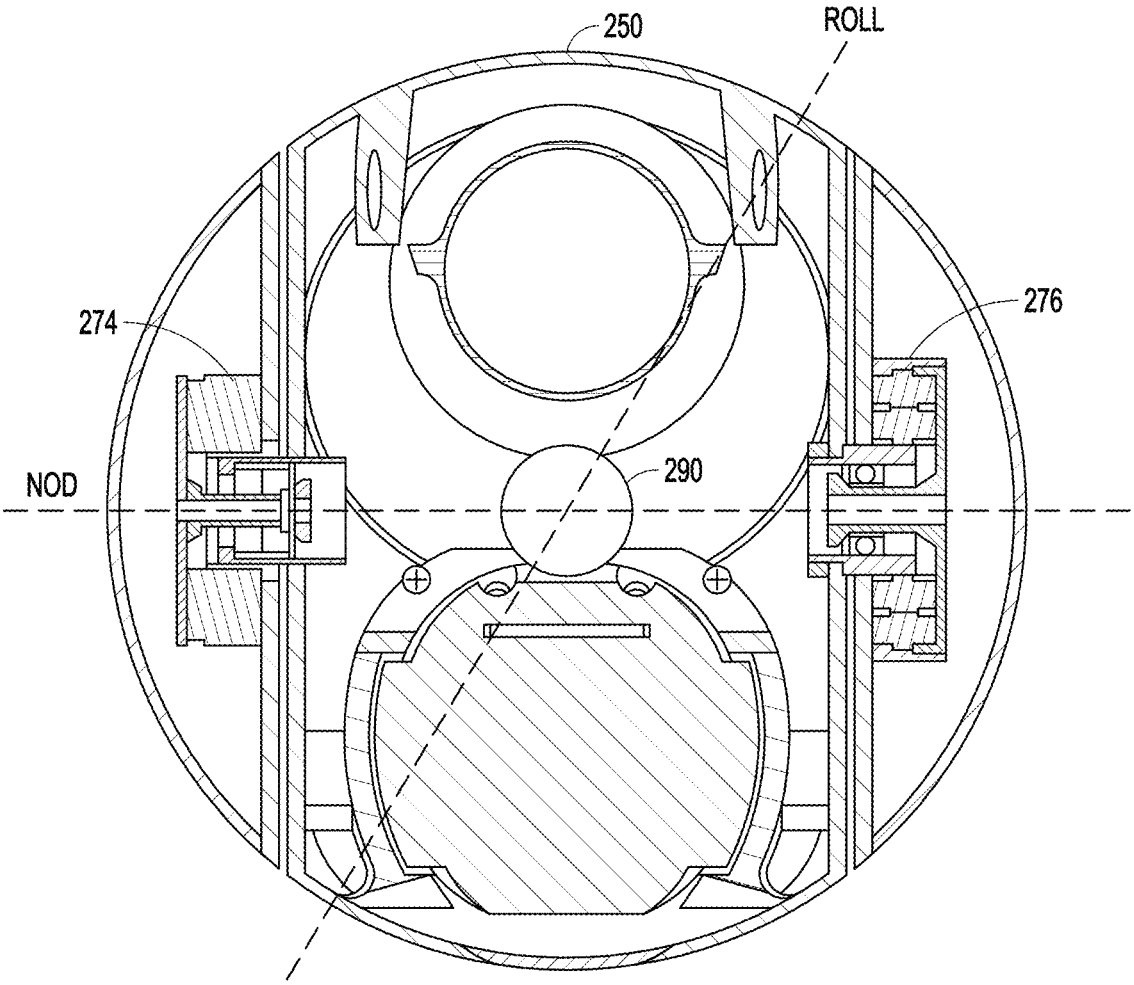

Referring now to FIGS. 4A-4B, in the terminal phase of target engagement, just prior to detonation of forming warhead 202, a controller implemented in processing electronics 220 issues a command to seeker electronics 222 to cause the nod motor 274 to rotate the nod assembly 250 to the nominal nod angle such that at detonation forming warhead 202 forms a penetrator 290 in the volume formed by the roll bearing/motor and open end of the dome that moves unimpeded along the roll axis 214 and unobstructed path 280 through the dome. Neither the roll/nod gimbal structures nor the seeker structures impede the penetrator 290 as it travels along the roll axis 214 through the dome.

Traditionally, an EO (IR, Visible, UV, SAL.) seeker is symmetrically bore sighted with a spherical dome. This allows traditional spherical or parabolic lenses within the seeker to collect and focus light onto the focal plane. In the disclosed dual-mode roll/nod gimballed seeker, both of the seekers are off-axis from the spherical dome.

Figure 5:
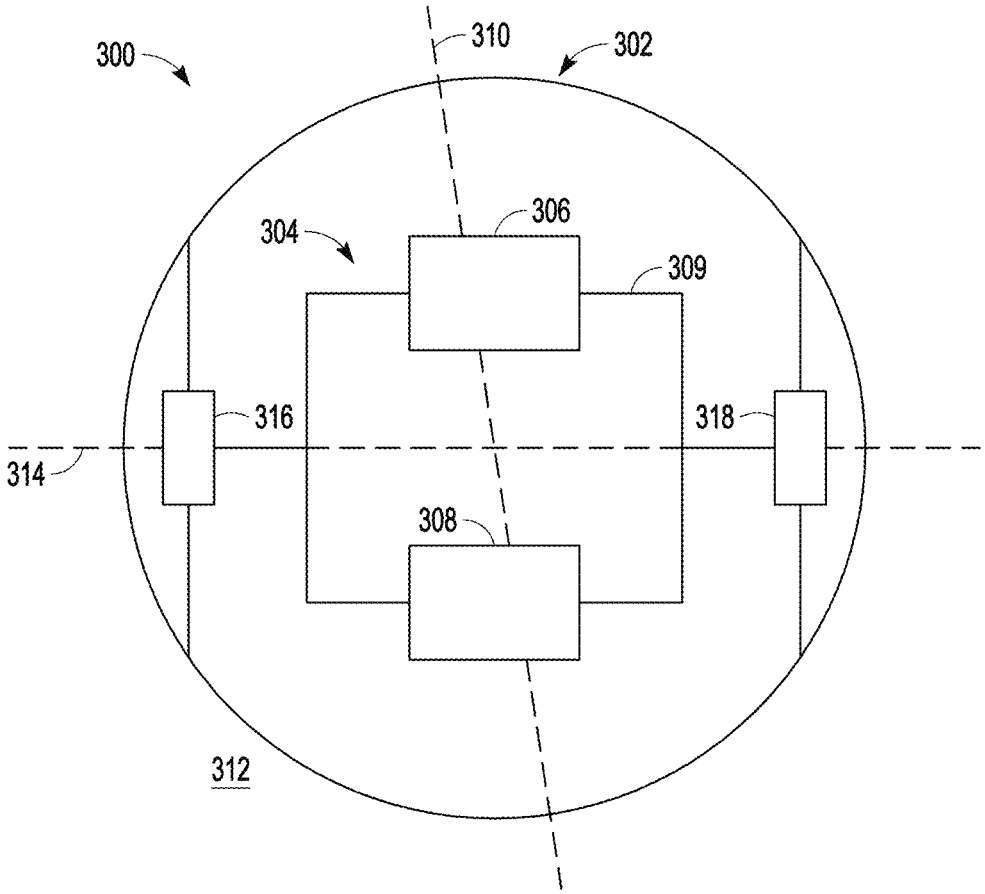
FIG. 5 is an end on section view of an alternate embodiment of the seeker in which the nod assembly rotates within a 1-piece dome

As shown in FIG. 5, an embodiment of a dual-mode roll/nod gimbal 300 for use with a forming warhead uses a 1-piece dome 302 mounted on the roll gimbal as previously described. The 1-piece dome 302 rolls through the roll FOR but is fixed in nod. A nod assembly 304 includes first and second seekers 306 and 308, respectively, on a mounting structure 309 that are offset from a roll axis 310, and more particular positioned on opposing sides and spaced apart from a roll/nod plane 312 formed by roll axis 310 and a nod axis 314. Nod motor 316 and nod resolver 318 are positioned on nod axis 314 towards opposing sides of and fixed to 1-piece dome 302 so as not to obstruct the path along the roll axis 310. The nod motor 316 rotates nod assembly 304 about nod axis 314 causing both seekers to traverse a nod FOR and move relative to 1-piece dome 302. The seekers cross roll axis 310 to scan the nod FOR. At a nominal nod angle, a path along roll axis 310 through the dome is unobstructed by either gimbal or seeker structures.

Figure 6:
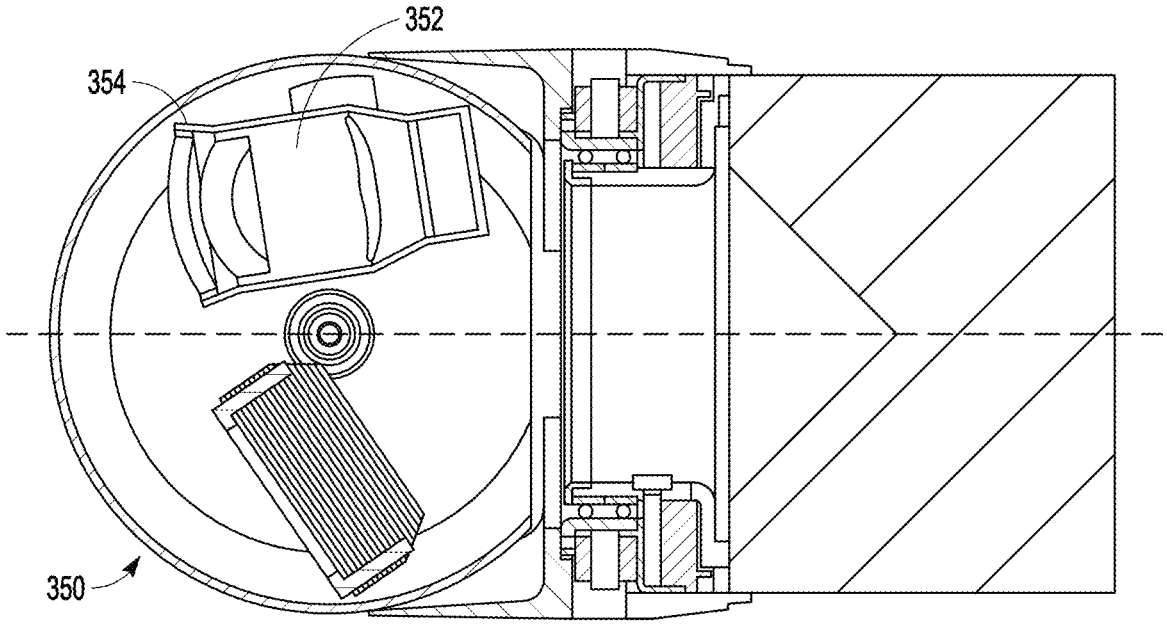
FIG. 6 is a side section view of a seeker having a spherical dome with EO and RF seekers and provided with an arch corrector for the EO seeker.

As shown in FIG. 6, after light is bent coming through a spherical dome 350 at various angles to the off-axis EO seeker 352, an additional lens called an arch-corrector 354 positioned in front of EO seeker 352 straightens out the light so it can enter the seeker 352 in normal parallel paths. This approach is viable whether using a 1-piece dome or the segmented dome in which the middle section of the dome rotates with the nod assembly.

Figure 7:
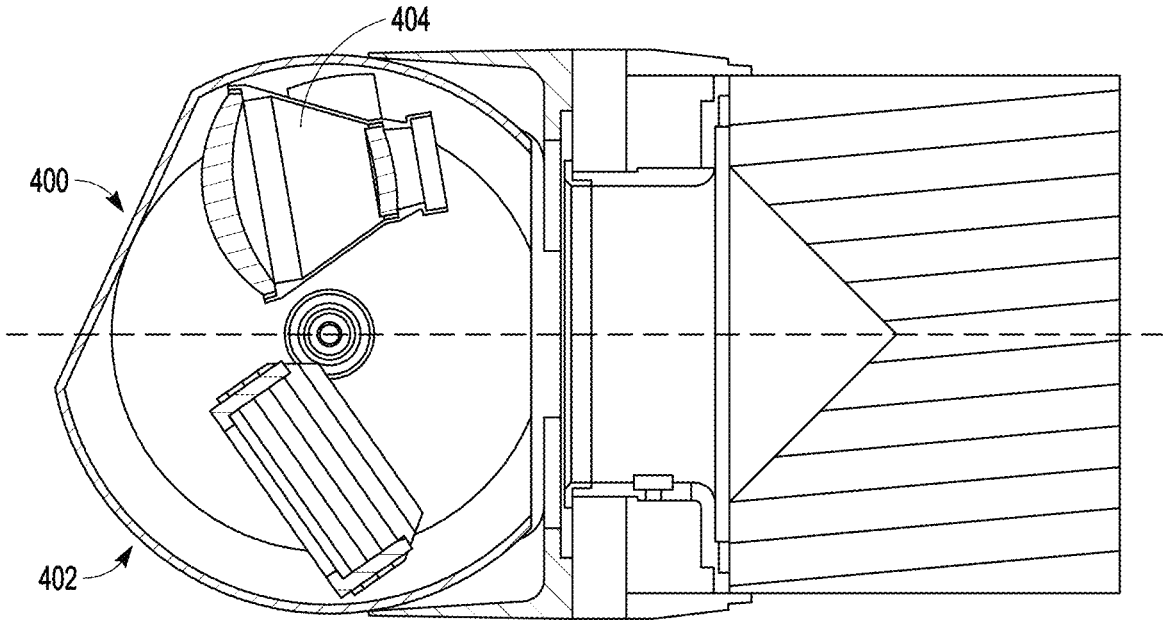
FIG. 7 is a side section view of a seeker having a dome with a generally spherical OML with EO and RF seekers in which a portion of the dome used by the EO includes a flat window.

As shown in FIG. 7, a flat window 400 is formed in the spherical dome 402 opposite to an off-axis EO seeker 404 so that light passing through flat window 400 remains parallel. This approach is only viable for the segmented dome.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A warhead and seeker assembly, comprising:

an airframe having a roll axis and a nod axis perpendicular to the roll axis;

a forming warhead positioned within the airframe and configured to project a penetrator forward along the roll axis upon detonation;

a roll gimbal positioned forward of the forming warhead;

a dome positioned on the roll gimbal to rotate around the roll axis;

a nod assembly including, a first seeker positioned within the dome, said first seeker having a first FOV that projects forward through the dome; and a second seeker positioned within the dome, said second seeker having a second FOV that projects forward through the dome such that the first and second field of view (FOV) overlap within a stand-off range to target;

a nod gimbal configured to rotate the nod assembly about the nod axis;

wherein said first and second seekers are separately offset from the roll axis such that at a nominal nod angle a path along the roll axis is unobstructed;

wherein rotation of said nod assembly about the nod axis over a nod field-of regard (FOR) causes the first and second seekers to cross the roll axis and obstruct the path along the roll axis; and a controller configured such that just prior to detonation of the forming warhead the controller commands the nod gimbal to rotate the nod assembly to the nominal nod angle such that the penetrator moves unimpeded along the roll axis and unobstructed path through the dome.

2. The seeker and warhead assembly of claim 1, wherein diameters of the airframe and dome are no greater than 8 inches.

3. The seeker and warhead assembly of claim 1, where the first and second seekers are fixed with respect to the nod assembly.

4. The seeker and warhead assembly of claim 1, wherein the dome includes an aft opening that defines a volume for formation of the penetrator upon detonation of the forming warhead.

5. The seeker and warhead assembly of claim 4, further comprising:

a membrane across the aft opening of the dome to prevent contamination of the first and second seekers.

6. The seeker and warhead assembly of claim 1, wherein the roll gimbal comprises:

a ring-shaped roll bearing and roll motor positioned between the airframe and dome to roll the dome about the roll axis without obstructing the path along the roll axis.

7. The seeker and warhead assembly of claim 6, wherein the roll gimbal further comprises a slip ring positioned between the airframe and the dome to pass electrical signals back-and-forth across the roll gimbal.

8. The seeker and warhead assembly of claim 1, wherein the dome includes a middle section positioned between first and second outer sections that project forward from the roll gimbal to rotate about the roll axis, wherein the nod assembly includes the middle section within which the first and second seekers are mounted spaced apart from and on opposing sides of a roll/nod plane at the nominal nod angle, said nod gimbal further including a nod motor positioned on the nod axis in the first outer section of the dome to rotate the nod assembly about the nod axis.

9. The seeker and warhead assembly of claim 8, wherein the first and second seekers operate in an EO and an RF band, respectively, wherein the middle section of the dome includes a first window transparent to the EO band opposite the first seeker and a second window transparent to the RF band opposite the second seeker.

10. The seeker and warhead assembly of claim 8, wherein the dome has a spherical shape, wherein the first seeker operates in an electro-optical mode and is positioned off-axis from the dome, further comprising an arch corrector positioned between the first seeker and the dome.

11. The seeker and warhead assembly of claim 8, wherein the first seeker operates in an electro-optical mode and is positioned off-axis from the dome, wherein the middle section of the dome includes a flat window.

12. The seeker and warhead assembly of claim 8, wherein the nod axis passes through a center of the dome such that rotation of the middle section of the dome stays within an outer mold line (OML) of the aircraft.

13. The seeker and warhead assembly of claim 1, wherein the entire dome rotates about the roll axis and is fixed with respect to the nod axis, wherein the first and second seekers are spaced apart from and on opposing sides of a roll/nod plane at the nominal nod angle, wherein the nod gimbal includes a nod motor positioned on the nod axis, within the dome to rotate the nod assembly about the nod axis.

14. The seeker and warhead assembly of claim 13, wherein the first and second seekers operate in different bands, wherein the dome includes a transparent window transparent to the different bands opposite the first and second seekers as they move relative to the dome through the nod FOR.

15. The seeker and warhead assembly of claim 1, wherein the first and second seekers are mounted spaced apart from and on opposing sides of a roll/nod plane at the nominal nod angle such that the penetrator moves along the unobstructed path between the first and second seekers.

16. A warhead and seeker assembly, comprising:

an airframe having a roll axis and a nod axis perpendicular to the roll axis;

a forming warhead positioned within the airframe and configured to project a penetrator forward along the roll axis upon detonation;

a roll gimbal including a ring-shaped roll bearing and a roll motor positioned forward of the forming warhead;

a dome including a middle section and first and second outer sections that project forward from the ring-shaped motor to rotate around the roll axis, said middle section of the dome having an aft opening that defines a volume for formation of the penetrator upon detonation of the forming warhead;

a nod assembly including, the middle section of the dome;

a first seeker at a fixed position within the middle section of the dome, said first seeker having a first field of view (FOV) that projects forward through the dome; and a second seeker at a fixed position within the middle section of the dome, said second seeker having a second FOV that projects forward through the dome such that the first and second FOV overlap within a stand-off range to target;

a nod gimbal including a nod motor positioned on the nod axis in the first outer section of the dome to rotate the nod assembly about the nod axis;

wherein at a nominal nod angle said first and second seekers are positioned on opposing sides of a roll/nod plane such that a path along the roll axis is unobstructed;

wherein rotation of said nod assembly about the nod axis over a nod field-of regard (FOR) causes the first and second seekers to cross the roll axis and obstruct the path along the roll axis; and a controller configured such that just prior to detonation of the forming warhead the controller commands the nod gimbal to rotate the nod assembly to the nominal nod angle such that the penetrator moves unimpeded along the roll axis and unobstructed path through the dome.

17. A seeker assembly for use with a forming warhead, comprising:

a roll gimbal configured to roll around a roll axis;

a dome positioned on the roll gimbal;

a nod assembly including, a first seeker positioned within the dome, said first seeker having a first field of view (FOV) that projects forward through the dome; and a second seeker positioned within the dome, said second seeker having a second FOV that projects forward through the dome such that the first and second FOV overlap within a stand-off range to target;

a nod gimbal configured to rotate the nod assembly about a nod axis perpendicular to the roll axis;

wherein said first and second seekers are separately offset from the roll axis such that at a nominal nod angle a path along the roll axis is unobstructed;

wherein rotation of said nod assembly about the nod axis over a nod field-of regard (FOR) causes the first and second seekers to cross the roll axis and obstruct the path along the roll axis; and said nod gimbal responsive to an electrical signal such that just prior to detonation of the forming warhead the nod gimbal rotates the nod assembly to the nominal nod angle such that the penetrator moves unimpeded along the roll axis and unobstructed path through the dome.

18. The seeker of claim 17, wherein the roll gimbal comprises:

a ring-shaped roll bearing and a roll motor to roll the dome about the roll axis without obstructing the path along the roll axis.

19. The seeker of claim 17, wherein the dome includes a middle section positioned between first and second outer sections, wherein the nod gimbal includes a ring coupled to the ring-shaped motor and from which the first and second outer sections are fixed and project forward to rotate about the roll axis, wherein the nod assembly includes the middle section within which the first and second seekers are mounted, said nod gimbal further including a nod motor positioned on the nod axis in the first outer section of the dome to rotate the nod assembly about the nod axis.

20. The seeker of claim 17, wherein at the nominal nod angle the first and second seekers are mounted spaced apart from and on opposing sides of a roll/nod plane.

* * * * *